US006330771B1

(12) United States Patent
Hester, Jr.

(10) Patent No.: US 6,330,771 B1
(45) Date of Patent: Dec. 18, 2001

(54) SAFER SCHOOL MODULE AND ASSEMBLY

(76) Inventor: Charles W. Hester, Jr., 842 W. Main St., Laurens, SC (US) 29360

( * ) Notice: Subject to any disclaimer, the term of this patent is extended or adjusted under 35 U.S.C. 154(b) by 0 days.

(21) Appl. No.: 09/497,969

(22) Filed: Feb. 4, 2000

(51) Int. Cl.[7] ..... E04H 3/08
(52) U.S. Cl. ..... 52/234; 52/79.1; 52/106
(58) Field of Search ..... 52/79.1, 79.7, 52/79.8, 79.9, 79.13, 106, 169.2, 169.3, 234; 292/21, 92, 251.5

(56) References Cited

U.S. PATENT DOCUMENTS

| | | | | |
|---|---|---|---|---|
| Re. 35,268 | * | 6/1996 | Frolov et al. | 340/545 |
| 3,254,458 | | 6/1966 | Van Der Lely . | |
| 3,452,492 | | 7/1969 | Brockway . | |
| 3,553,911 | | 1/1971 | Morrow et al. . | |
| 4,599,829 | * | 7/1986 | Dimartino, Sr. | 52/79.7 |
| 4,609,910 | * | 9/1986 | Geringer et al. | 340/545 |
| 4,631,528 | * | 12/1986 | Handel et al. | 340/545 |
| 5,065,136 | * | 11/1991 | Frolov et al. | 340/545 |
| 5,167,842 | | 12/1992 | Vercelletto . | |
| 5,261,197 | | 11/1993 | Pickle, Sr. . | |
| 5,351,450 | | 10/1994 | Moskowitz . | |

* cited by examiner

*Primary Examiner*—Carl D. Friedman
*Assistant Examiner*—Yvonne M. Horton
(74) *Attorney, Agent, or Firm*—Flint & Kim, P.A.

(57) ABSTRACT

A safe school complex which includes a plurality of classroom modules joined together to form an enclosed courtyard. The courtyard may be a park or play area depending on the needs of the school. A covered walkway surrounds the courtyard in what is commonly referred to as a race track design. Each module has a two way front entrance door having access from the covered walkway. Each module further comprises an emergency exit at the rear of the classroom module. A controlled access entrance unit is provided for controlled and secure entrance to the courtyard and classroom modules through entryway. The classroom modules also include an alarm system which includes a visual indicator in the form of a flashing light, and an audio indicator in the form of an alarm horn contained within an indicator housing.

39 Claims, 6 Drawing Sheets

SAFER SCHOOL MODULE AND ASSEMBLY

BACKGROUND OF THE INVENTION

The invention relates to the provision of a safe school environment using modules which can be assembled as needed to provide controlled access when the modules are formed into a complex.

Recently the number of school related shooting events that result in tragedy and death have increased. The conventional constructions of schools makes security difficult in the case of unauthorized intruders, or even students, with firearms. In particular, disturbing events have occurred in schools in which students have been trapped in the presence of a gunman and the students had little opportunity to escape as the gunman began shooting. In addition, the use of portable buildings have increased in schools as schools have become over crowded. Mobile buildings are often located independently on the school grounds near the main buildings. The portable buildings stand alone and are difficult to secure against intruders. Conventional school designs have not provided readily secured environments for students. The school designs do not permit the addition of space in a secure manner as needed in order to accommodate school growth.

Accordingly, an important object of the present invention is to provide a modular school design which allows controlled access.

Another object is to provide individual class room modules that may be formed into a secure complex that minimizes the entrapment spaces for students in the event an intruder does gain access.

Another object of the invention is to provide a modular school complex which may be expanded as needed while maintaining controlled access.

Another object of the present invention is to provide a school design which incorporates individual modules that can be formed together into a complex having an enclosed courtyard.

Another object of the present invention is to provide school classroom modules having a controlled entrance and emergency exits which allows for the students to escape the classroom in an emergency in a direction opposite to which an intruder may enter.

Another object of the present invention is to provide a classroom module having an entrance accessible from an enclosed courtyard and an exit to the outside when the emergency exit initiates an alarm when opened.

Another object of the invention is to provide an inexpensive method of assembly for classroom modules that can be added as needed to a complex while the security of the complex is maintained.

SUMMARY OF THE INVENTION

The above objectives are accomplished according to the invention by providing a safe school complex having a secure environment for students against the entrance by an outside intruder. The complex comprises a plurality of individual classroom modules joined together to form a complex and an open air enclosed courtyard defined within an interior perimeter of said complex. The classroom modules have a front entrance and a front door for closing the front entrance included in courtyard walls of the modules, wherein the front entrance opens into the enclosed courtyard. The classroom modules have emergency exits formed in exterior walls of the modules opposite the courtyard walls. Each emergency exit has an emergency door for closing the emergency exit wherein the emergency exit opens to the outside of the complex away from the enclosed courtyard. Advantageously, the emergency door has a secured closed position and an open position for emergency evacuation. A detector is provided for detecting movement of the emergency door from the closed position and for generating a signal activating an alarm system in response to the movement. Preferably, the alarm system emits an audio and a visual signal indicating that the emergency door has been moved from the closed position to an open position so that the school complex may be placed on alarm that a classroom module is being evacuated.

Advantageously, the front door includes a manual door closure having a door latch which may be opened from either side of the front door to permit two-way traffic in and out of the classroom module. The emergency door includes an emergency door closure having a door latch which may be opened only from an interior side of the emergency door and module. A detector is provided having an actuated position when the emergency door is open for evacuation, and a de-actuated, secure position when the emergency door is closed. The alarm system is activated when the detector is actuated.

Preferably, the alarm system includes a self-contained power supply in the event main power is lost to the classroom module. The alarm system includes a reset input for deactivating the alarm system so that the alarm signals are terminated. The reset input may include a removable key which may be carried by a teacher, the key being inserted into the alarm system being deactivated in response to the key being inserted into the alarm system. The emergency door latch has an engaged and disengaged position. The detector detects the emergency latch being in the engaged position when the door is secured in the closed position to maintain the alarm deactivation. Since the detector responds to the latch position, the alarm system may only be deactivated when the latch is in the secure, engaged position with the door closed.

The complex includes a single main entrance unit to allow a single point for entering and leaving the complex so that controlled access to the enclosed courtyard and classroom modules is achieved. Each classroom module has a first end and a second end. The front courtyard opening is disposed near the first end on the courtyard side and the emergency exit is disposed near the second end on the exterior side so that the occupants of the classroom module may evacuate through the emergency exit in a direction away from an intruder entering in the front entrance. A teaching station is disposed at the second end of the classroom module to facilitate control of the emergency exit by the teacher. The alarm system comprises a housing carried by the courtyard wall of the classroom modules, and the alarm signal includes a visual indicator carried by the housings, the housings disposed on the exterior of the courtyard wall so that individuals within the courtyard can immediately see the location of the emergency. The alarm reset input is disposed at the housing on the exterior of the courtyard wall.

A utility system includes an electrical power supply disposed in the exterior wall at the second end of the classroom module. The utility system includes an outdoor heat pump disposed adjacent the exterior wall at the second end of the module, and wherein the emergency door opens towards the heat pump so that the heat pump is behind the emergency door when the emergency door is opened for evacuation whereby the heat pump does not interfere with the evacuation.

An expansion joint is disposed between adjacent classroom modules for accommodating expansion and contraction between adjacent classroom modules in the complex. The expansion joint comprises an expansion space formed between adjacent end walls of adjacent modules, and a vertically extending seal formed between adjacent end walls at the front and rear of the expansion space. The seal comprises a backfill post, and resilient sealing material filled in between the posts and the exterior of the module. A roof is included on the classroom module, and a roof joint is formed between adjacent ends of the roof of the modules with a roof cap secured over the roof joints of adjacent roofs. The classroom modules have a courtyard wall, a first end wall, an exterior wall, and a second end wall forming generally a rectangle. The first end wall and the second end wall of adjacent walls form a double wall between modules. The courtyard edge of the first end wall and the courtyard edge of the second end wall include connection points for connecting the edges of adjacent modules to close the gap along adjoining modules.

Preferably a security station is disposed generally near the entryway for guarding the movement of occupants in and out of the complex through the entryway. The security station can include a metal detector for the early detection of firearms and other metallic weapons prior to entry into the complex.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
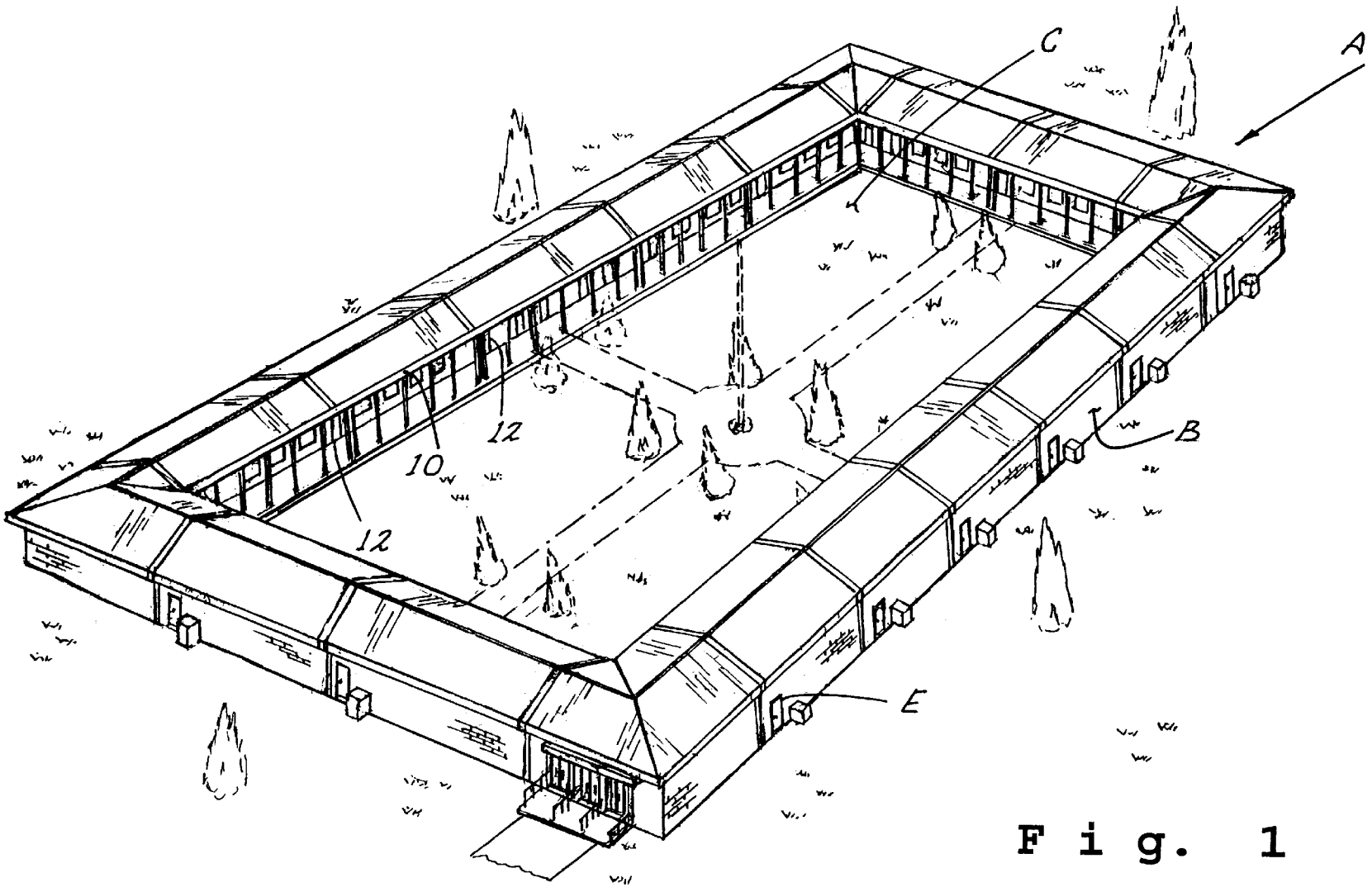
FIG. 1 is a perspective view illustrating a safe school modular complex having an enclosed courtyard according to the invention.

As can best be seen in FIG. 1, a safe school complex, designated generally as A, which includes a plurality of classroom modules B joined together to form an enclosed open air courtyard designated generally as C. The courtyard may be a park or play area depending on the needs of the school. A covered walkway generally designated as 10 surrounds the courtyard in what is commonly referred to as a race track design. Each module B has a front entrance door 12 which accommodates two way traffic to and from the covered walkway. Each module further comprises an emergency exit designated generally as E at the rear of the classroom module. A controlled access entrance unit designated generally as 26 (FIG. 2) is provided for controlled and secure entrance to the courtyard C and classroom modules B through entryways 12.

Figure 2:
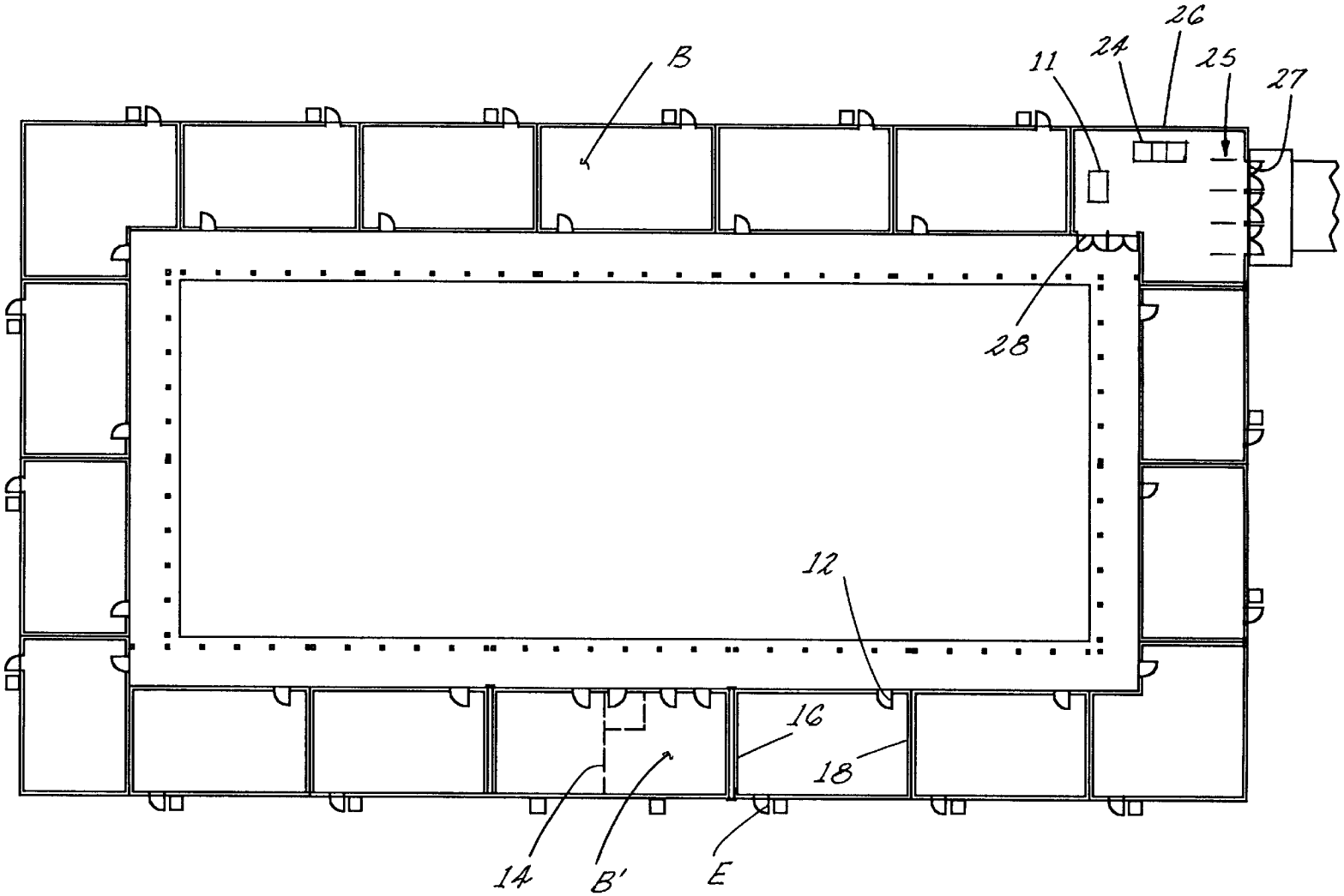
FIG. 2 is a top plan view of a floor plan of a safe school modular complex according to the invention.

As can best be seen in FIG. 2, individual classroom modules B can be provided either by a partitioned classroom modules B' or by independent modules B. The partitioned modules B' include a pair of rooms separated by a common wall 14 within the module. The independent classrooms B include a first wall 16 and a second wall 18 which are exclusively associated with the module. Therefore, additional modules may be added to meet the demands of growth by merely building or otherwise adding another module. By having self-contained modules, the addition of new modules does not disrupt the classes and teachings being performed in the existing modules. In either case, the classroom module includes a two way front entrance door 12 and a rear emergency exit E.

Also included in the complex is a entrance unit 26 which provides for secured controlled access to the interior of the complex and the classroom modules. The entrance unit can be integrated into the complex in the same manner as a classroom module to maintain the integrity of an enclosed complex. An entryway 27 is included within the entrance module so that controlled two-way traffic is achieved.

Once an individual enters the entrance unit through entryway 27, the individual may be subject to a metal detector 25 or x-ray machine 24 for both the individual's person as well as carried objects. Additionally, security cameras, card access turnstiles, and other security means can be included in the entrance unit. A security station 11 may also be included within entrance unit 26 to further control or restrict the access to the complex. When an individual passes the security measures of the entrance unit, the student can enter the complex through the inner doorway 28 of the entrance unit.

Figure 3:
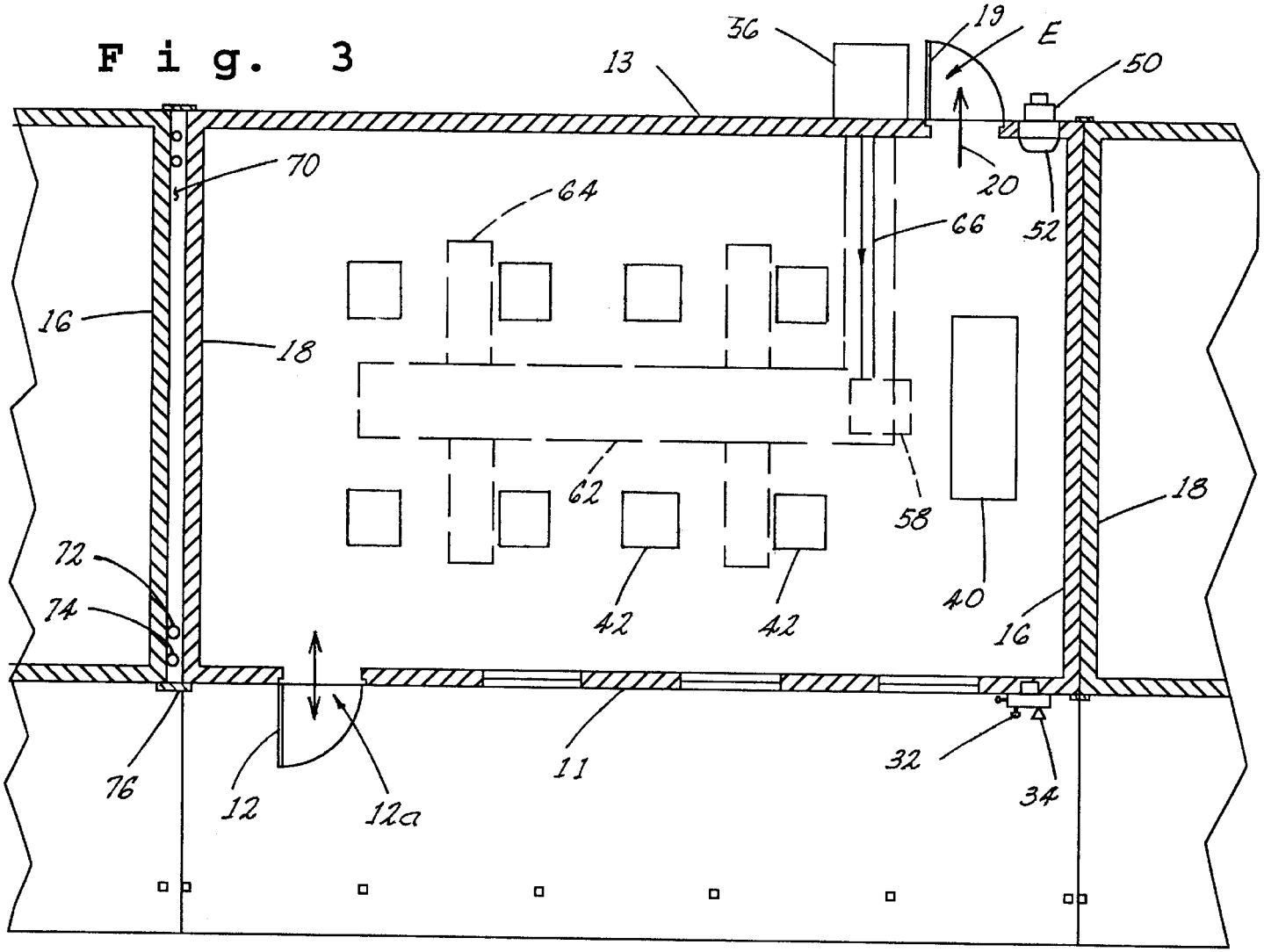
FIG. 3 is a top plan view of an individual classroom module for a safe school complex according to the invention.

As can best be seen in FIG. 3, individual classroom modules include front door 12 included in a front door opening 12*a* which provides two way traffic in and out of the classroom as shown by the arrow. Door 12 may be a conventional door. Emergency exit E is designed for only one way traffic, as shown by arrow 20, to permit the occupants to escape to the outside, away from the courtyard and classroom module. Advantageously, the emergency exit E is located in exterior wall 13 at or near the intersection of exterior wall 13 and first wall 16. Front door 12 is located in courtyard wall 11 at or near the intersection of second wall 18 and courtyard wall 11. This configuration allows the students or occupants of the classroom to expediently flee the classroom in the direction away from an intruder entering in through entrance door 12. In this manner, entrapment of the occupants is minimized and none of the students have to go in a direction of the intruder, nor do the students run into each other as in the case of a middle door where they converge from opposite directions. As illustrated, the room arrangement includes the teachers desk 40 at the end or near the end of the room where emergency exit E is located. The students desks 42 are arranged facing the teacher.

Figure 5:
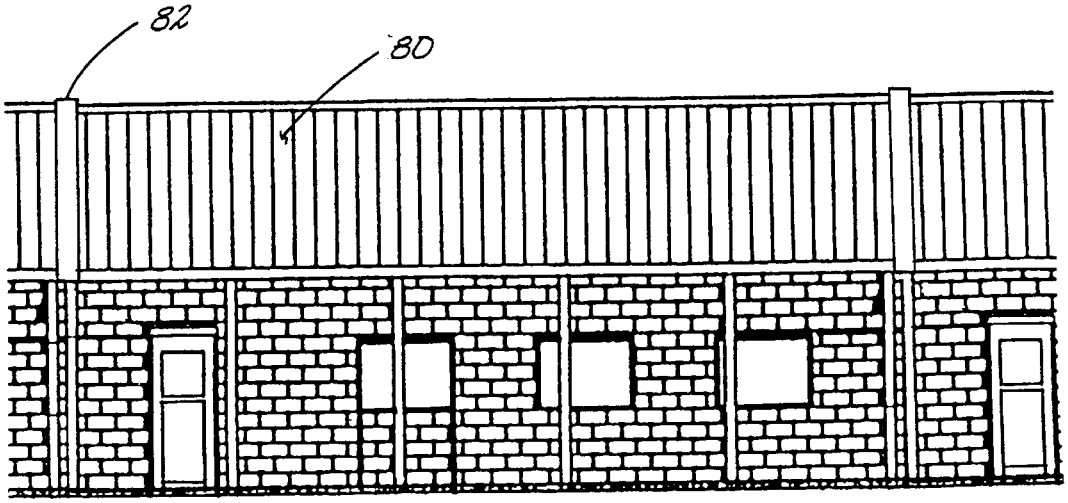
FIG. 5 is a front view of a classroom module for a secure school complex according to the invention.

Adjacent independent modules B are joined together by means of an expansion joint 70, flexible backing column 72 disposed at each end of the expansion space and with a semi-rigid filling material 74. To finish the expansion joint, trim molding 76 may be disposed along the height of the joint. As can best be seen in FIG. 5, metal or other conventional roofing 80 is provided to cover the attic of each module. The roofs of adjoining modules include a joint cap 82 which fits over a joint between adjacent roof edges.

Figure 4:
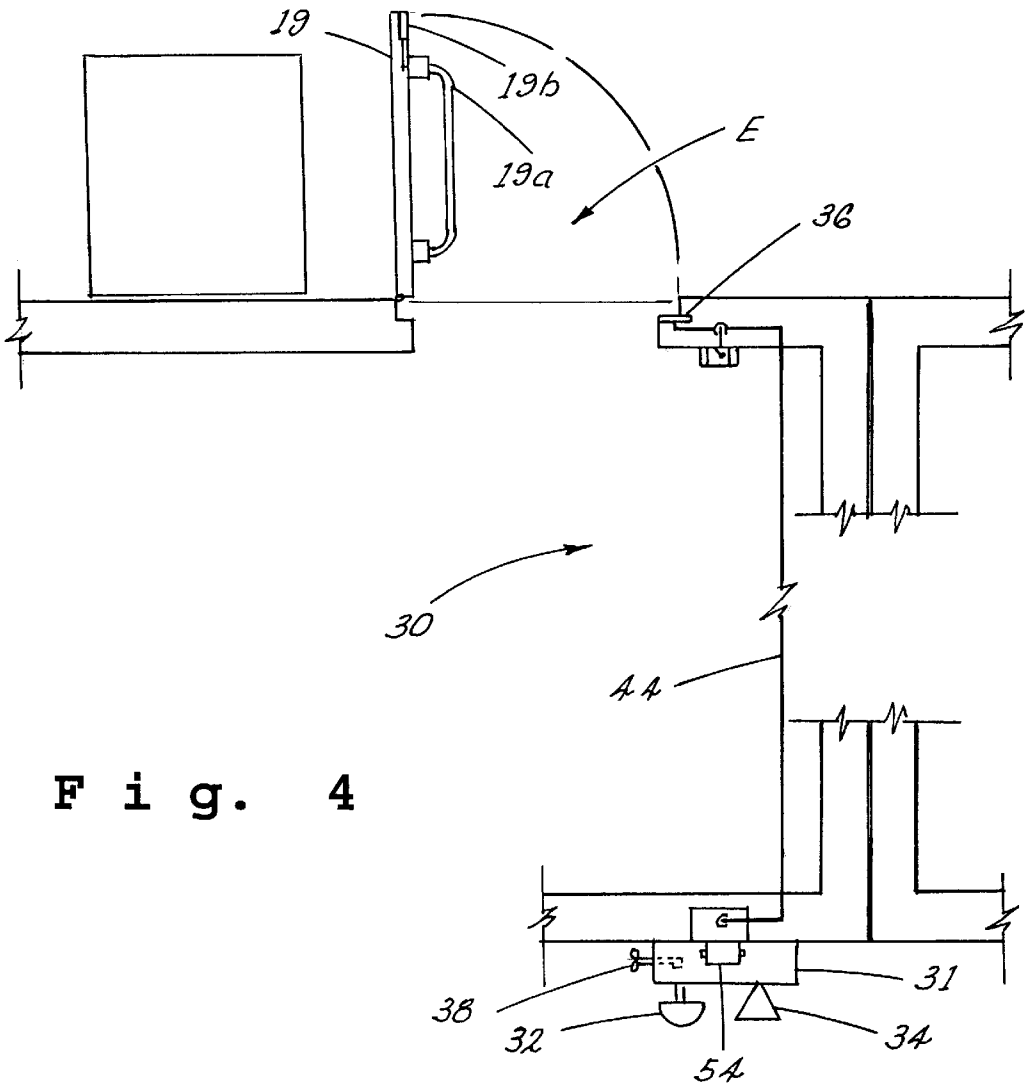
FIG. 4 is a top view of the alarm system as connected to the emergency door.

The classroom modules also include an alarm system designated generally as 30 (FIG. 4) includes a visual indicator 32 in the form of a flashing light, and an audio indicator in the form of an alarm horn 34 contained within an indicator housing 31. FIG. 4 illustrates the alarm system in more detail. The indicators are activated by a detector, designated as 36 which detects opening of emergency door 19 of emergency exit E. Emergency door 19 is opened only from inside the module by engagement of panic bar 19*a* in a conventional manner. The alarm is activated regardless of the manner or reason the door is opened. If it is an accident, the teacher resets the alarm by inserting a key 38 into the alarm system to key the alarm off. In the event of an intruder, the alarm is not keyed off until the emergency situation is over. Detector 36 is wired to indicator housing 31 and the indicators by a means of a wire 44. When the door is opened the circuit is open and the alarm goes off. The alarm system may also have a self-contained power source or back-up power source 54 so that the alarm will be activated even when main power is lost to the classroom module.

In another embodiment of the invention, the alarm system is designed so that the alarm cannot be keyed off while the door is open. It is also preferred that the detector 36 be provided so that the alarm system circuit will not allow the indicator to be deactivated unless the door latch 19*b* is inserted in the detector opening. This provides the advantage that the alarm system cannot be keyed off unless the door is closed and the latch is engaged preventing someone from defeating the alarm by "jamming" the latch.

In order to further provide a self-contained classroom module, FIG. 3 illustrates that a utility system is provided which includes an outdoor electrical service 50 such as a electrical meter, and an indoor service and breaker box 52 which are conventional. It is preferred that the service box and the alarm system 30 be disposed on the same ends of exterior wall 13 and courtyard wall 11. This minimizes the wiring needed and locates the service box nearest the teachers' desk. However, it is noted that a backup power supply 54 is provided for alarm indicators 32 and 34 to provide power to the alarm system even in the event of a power outage, or if power is shut off at the breaker box. In this event, power is still supplied to the alarm system by the backup battery so that the alarm is activated if opening of the door is detected.

The utility system also includes a heat pump 56 (FIG. 3), which is advantageously disposed behind emergency door 19 outside exterior wall 13. An air handling unit 58 is disposed in an attic of each module that is connected to a distribution manifold 62 having side supply ducts 64. These supply ducts are connected to air registers that distribute the air into the classroom. Refrigerant lines 66 are connected between the air handler and heat pump for heating or cooling air, as needed, in a conventional manner. Locating the air handler at the end of the supply manifold maximizes efficiency of the heating system. Additionally, the location of the heat pump at the second side with the air handling unit minimizes the length of the refrigerant lines needed to connect the air handler to the heat pump. Opening of the door against the heat pump provides a flat open exit opening for the occupants or student to flee the classroom and reduces the risk that the heat pump will interfere with the students departure.

Figure 7:
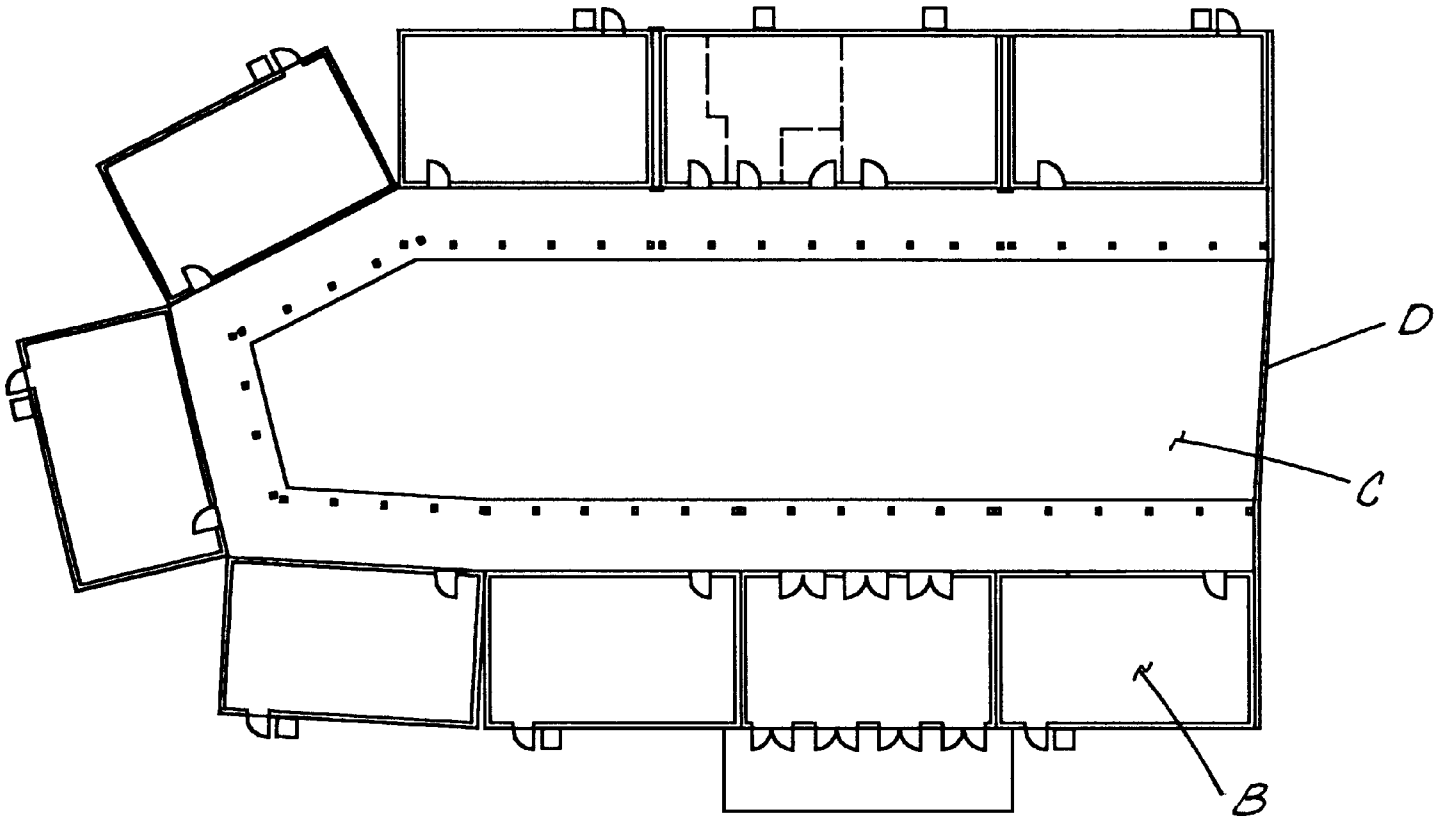

FIG. 7 illustrates a compound with an asymmetrical organization having enclosed courtyard C, a plurality of classrooms B, and a security wall D. The security wall encloses the courtyard without the need for modules to be positioned along the entire perimeter of the courtyard. Additionally, more classroom modules can be added to the complex by merely removing wall D, adding more modules, and replacing D.

Figure 6:
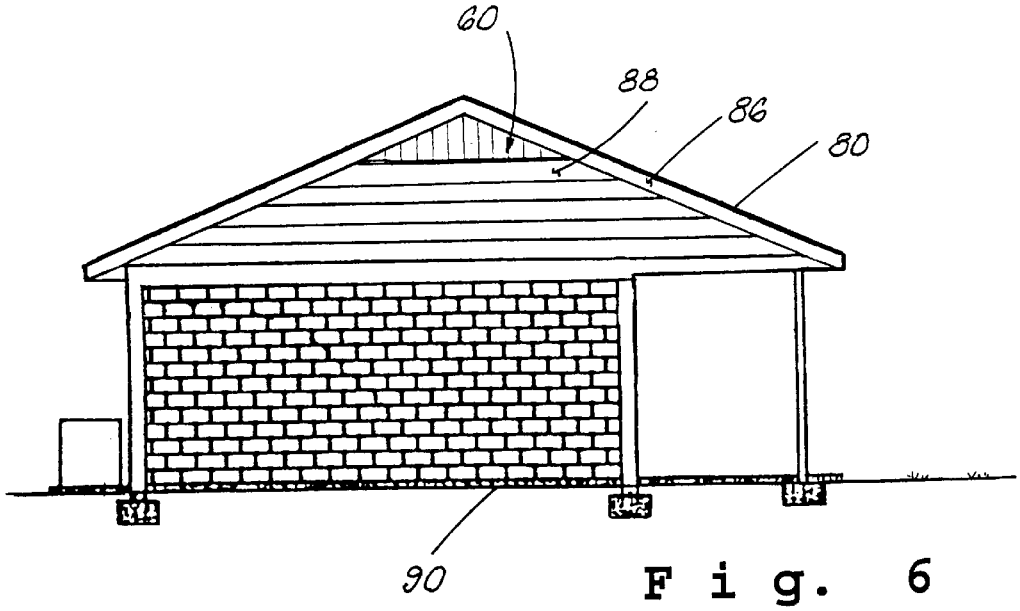
FIG. 6 is an end view elevation showing the joinder of two classroom modules according to the invention; and, FIG. 7 is a top plan view of an alternate embodiment of a safe school complex composed of individual modules according to the invention.

As can be seen, it is possible for the complex to have modules which do not meet with an evenly spaced joint, but may be adjacent at the courtyard or exterior wall edges. In the event that the enclosed courtyard is provided by a wall rather than a plurality of modules on one side, the end classroom modules may be provided with an end cap 86 (FIG. 6) that fits over a joint between roofing 80 and siding 88 which encloses attic 60. The double wall construction of the independent modular unit provides a two hour firewall that is needed between every seven units. In this manner, a two hour firewall is provided between each independent unit. When successive modules B are added either during or after construction to accommodate growth, a foundation 90 of the existing module is merely extended to add on the additional modules.

While a preferred embodiment of the invention has been described using specific terms, such description is for illustrative purposes only, and it is to be understood that changes and variations may be made without departing from the spirit or scope of the following claims.

What is claimed is:

1. An expandable safe school complex for providing a secure environment for students against the entrance by an outside intruder comprising;

a plurality of individual classroom modules forming individual class rooms joined together to form a complex having an open air enclosed courtyard;

said classroom modules having a front entrance with a front door providing access between said classroom and said enclosed courtyard;

each of said classroom modules having an emergency exit formed in an exterior wall of each said classroom module opposite said courtyard walls opening to the outside of said complex away from said enclosed courtyard;

each said emergency door having an emergency latch securing said emergency door in secured closed position;

each said emergency latch having a single activating member within said classroom for releasing said emergency door to an open position for emergency escape;

a detector for detecting movement of said emergency door from said closed position and for generating a signal activating an alarm system in response to said movement; and, said alarm system emitting a signal indicating that said emergency door has been moved from said closed position notifying the school complex that a classroom module is open away from said enclosed courtyard.

2. The complex of claim 1 wherein said complex includes an entrance module;

said entrance module including an entrance way through an outside wall providing a single point for entering and leaving said complex so that controlled access to said enclosed courtyard and classroom modules is achieved.

3. The complex of claim 1 wherein said front door includes a manual door closure having a door latch activated from either side of said front door to permit two-way traffic in and out of said classroom module.

4. The complex of claim 1 wherein said alarm system includes a back-up power supply for supplying power to said alarm system in the event main power is lost to the classroom module.

5. The complex of claim 1 wherein said alarm system includes a reset input for deactivating said alarm system so that said signal indicators are terminated.

6. The complex of claim 5 wherein said reset input comprises a removable key which may be carried by a teacher, said key being inserted into said alarm system for deactivating said alarm system in response to said key being inserted into said alarm system; and, said detector having an actuated position when said emergency door is open for evacuation, and a deactivated position when said emergency door is closed said alarm system being activated when said detector is in said actuated position.

7. The complex of claim 6 further comprising an emergency door latch having an engaged and disengaged position, said detector detecting said emergency latch being in said engaged position with said door secured in said closed position to maintain said alarm deactivation.

8. The complex of claim 7 wherein said detector is activated by said latch so that said alarm system may only be deactivated when said latch is in said engaged position.

9. The complex of claim 1 wherein said detector is operative to detect said emergency latch being in said engaged position maintaining said alarm deactivation.

10. The complex of claim 1 wherein:

each said classroom module has a first wall and a second wall;

said front entrance is disposed near said on said courtyard side and said emergency exit being disposed near said first wall on said exterior side so that the occupants of said classroom module may evacuate through said emergency exit in a direction away from an intruder entering in said front entrance.

11. The complex of claim 10 including a teaching station disposed adjacent said first end of said classroom module to facilitate control of said emergency exit by the teacher.

12. The complex of claim 11 wherein said alarm system comprises a housing carried by said courtyard wall of each said classroom module, and said alarm signal includes a visual indicator carried by said housings, said housings being disposed on the exterior of said courtyard wall so that individuals within the courtyard can immediately see the location of the emergency.

13. The complex of claim 12 wherein said reset input is disposed at said housing on the exterior of said courtyard wall.

14. The complex of claim 1 including a utility system having an electrical power supply disposed in said exterior wall at said first end of each said classroom module.

15. The complex of claim 14 wherein said utility systems includes an outdoor heat pump disposed adjacent said exterior wall adjacent said first end of said module, and wherein said emergency door opens towards said heat pump so that said heat pump is behind said emergency door when said emergency door is opened for evacuation.

16. The complex of claim 13 wherein said utility systems includes an air handling unit disposed in an attic of each said classroom module, an air supply manifold connected to said air handling unit for distributing air into each said classroom, said air handling unit being disposed adjacent said first end of each said classroom module.

17. The complex of claim 1 including an expansion joint disposed between first and second walls of adjacent classroom modules for accommodating expansion and contraction between adjacent classroom modules in said complex.

18. The complex of claim 17 wherein said expansion joint comprises an expansion space and a vertically extending seal formed between said adjacent first and second walls at the front and rear of said expansion space.

19. The complex of claim 18 wherein said seal comprises a backfill post, and resilient sealing material filled in between said posts and the exterior of said module.

20. The complex of claim 1 wherein:

each said classroom module includes a roof and said complex includes a roof joint and roof caps between adjacent ends of said roofs of each said classroom modules.

21. The complex of claim 20 further comprising a siding for covering an exposed end of selected of said classroom module below the roof line.

22. The complex of claim 20 wherein said first end wall and said second end wall of adjacent walls form a double wall between modules.

23. The complex of claim 2 wherein said entrance modules includes a security station disposed generally near said entryway for securing the movement of occupants in and out of said complex through said entryway.

24. The complex of claim 23 wherein said security station includes a metal detector for the early detection of firearms and other metallic weapons prior to entry into said complex.

25. The complex of claim 23 wherein said security station includes an x-ray machine for screening materials entering said complex to detect hazardous or dangerous materials from entering said complex.

26. A classroom module for building an expandable complex of a plurality of said classroom modules comprising:

a classroom formed by a courtyard wall, a first end wall, a second end wall, an exterior wall opposite said courtyard wall, and a roof, said roof forming an attic above said classroom;

a front entrance with a front door for opening and closing said front entrance included in said courtyard wall adjacent said second wall;

an emergency exit formed in said exterior wall adjacent said first end wall, said emergency exit having an emergency door having an open and closed position for opening and closing said emergency exit;

said emergency door having a latch and a latch activating member located within said interior, said latch being operative to maintain said emergency doors in said closed position;

a detector for detecting movement of said emergency door from said closed position and for generating a signal activating an alarm system in response to said movement; and, said alarm system emitting at least an audio signal indicating that said emergency door has been moved from said closed position notifying occupants that a classroom module is being evacuated or security has been breached.

27. The module of claim 26 wherein said detector includes an actuated position when said emergency door is open, and a deactivated position when said emergency door is closed, said alarm system being activated when said detector is in said actuated position.

28. The module of claim 27 wherein said alarm system includes a self-contained reserve power supply supplying power to said alarm system in the even main power is lost.

29. The module of claim 28 wherein said alarm system includes a reset input for deactivating said alarm system so that said signal indicators are terminated.

30. The module of claim 29 wherein said reset input comprises a removable key, said key being inserted into said alarm system for deactivating said alarm system when said emergency door is reduced to said secured position.

31. The module of claim 26 wherein said detector detects said emergency latch in said engaged position with said emergency door secured in said closed position maintaining said alarm deactivation.

32. The complex of claim 26 including a utility system having an electrical power supply disposed in said exterior wall adjacent said first end of said classroom module.

33. The complex of claim 32 wherein said utility system includes an outdoor heat pump disposed adjacent said exterior wall at said second end of said module, and wherein said emergency door opens towards said heat pump.

34. The complex of claim 33 wherein said utility system includes an air handling unit disposed in said attic of said classroom module and an air supply manifold connected to said air handling unit for distributing air into said classroom said air handling unit being disposed adjacent said first end of said classroom module.

35. An expandable safe school complex comprising:

a plurality of outer walls forming an enclosed open air courtyard;

a plurality of independent room modules each having a windowless exterior wall, an interior wall, a first end wall, a second end wall, a roof and a floor, said room modules being interconnected so that said exterior walls of said room module form at least first and second ones of said outer walls;

at least one of said room modules comprising an entrance room module having two way doors through said exterior wall and said interior wall, said two way doors allowing entry into and exit from said courtyard from outside said complex;

a majority of said room modules comprising classroom modules each having a two way door in said interior wall allowing entry into and exit from said classroom module from said courtyard, each said classroom module further having an emergency one way door in said exterior wall preventing entry into said classroom module from outside said complex;

a utility system including a heat pump connected with each said classroom module through said exterior wall, said utility system providing independent temperature control for each said classroom module whereby;

said school complex includes a plurality of said classroom modules each completely shielded from outside said courtyard and with controlled entry from said courtyard.

36. The school complex of claim 35 wherein at least one of said outer walls comprises a security wall.

37. The school complex of claim 36 wherein said security wall may be replaced with at least one of said exterior walls of one of said room modules thereby increasing the number of room modules forming said courtyard.

38. The school complex of claim 35 wherein said utility system includes a distribution manifold for distributing air from said heat pump into said classroom module, said distribution manifold being partially located in an attic beneath said roof of each said classroom module.

39. The school complex of claim 35 wherein said two way door and said emergency door are adjacent opposite ends of said classroom modules.

* * * * *